United States Patent [19]

Thurman et al.

[11] Patent Number: 4,576,020

[45] Date of Patent: Mar. 18, 1986

[54] JET PRINTER

[75] Inventors: Lamar Thurman; Billy J. Otting; David L. Otting, all of LaFayette, Ga.

[73] Assignee: Otting International, Inc., LaFayette, Ga.

[21] Appl. No.: 693,457

[22] Filed: Jan. 22, 1985

[51] Int. Cl.[4] ..... D06B 1/02; D06B 11/00

[52] U.S. Cl. ..... 68/205 R; 118/301; 118/313; 239/551

[58] Field of Search ..... 68/205 R; 118/301, 313; 239/551, 569, 586

[56] References Cited

U.S. PATENT DOCUMENTS

| | | | |
|---|---|---|---|
| 3,570,275 | 3/1971 | Weber et al. | 68/205 R |
| 4,254,644 | 3/1981 | Bartlett et al. | 68/205 R |
| 4,377,080 | 3/1983 | Fox | 68/205 R |
| 4,392,366 | 7/1983 | Godfrey | 68/205 R |

*Primary Examiner*—Philip R. Coe

*Attorney, Agent, or Firm*—Alan Ruderman

[57] ABSTRACT

A jet printer for dye printing a moving web of material by application of a selected plurality of streams of liquid dye. A dye supply tube corresponds to each dye stream and is disposed above a respective dye discharge tube which in turn is disposed above the moving web. A deflecting finger corresponding to each supply tube is pivotably mounted in a housing for selective movement into and out of the path of dye flowing from the supply tube. Each finger is carried by a support block which carries a permanent magnet in the form of a small cylindrical member. An electromagnetic coil in a control circuit is mounted with the core of the coil adjacent a peripheral portion of the magnet. Control circuitry selectively controls the polarity of the coil to attract one end of the magnet toward the coil and the other end repelled therefrom, and when the polarity changes the magnet moves in the opposite direction. Movement of the magnet pivots the respective support block and deflecting finger. When the deflecting finger moves into the path between the supply and discharge tubes the dye is deflected onto an inclined surface and is precluded from contacting the web.

29 Claims, 7 Drawing Figures

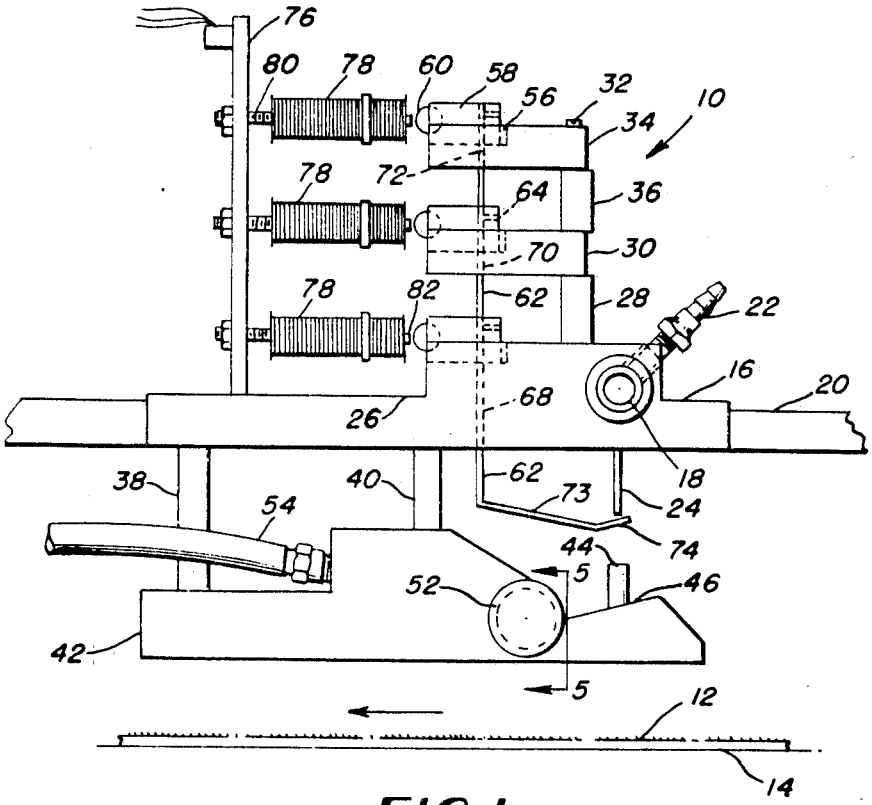
FIG. 1
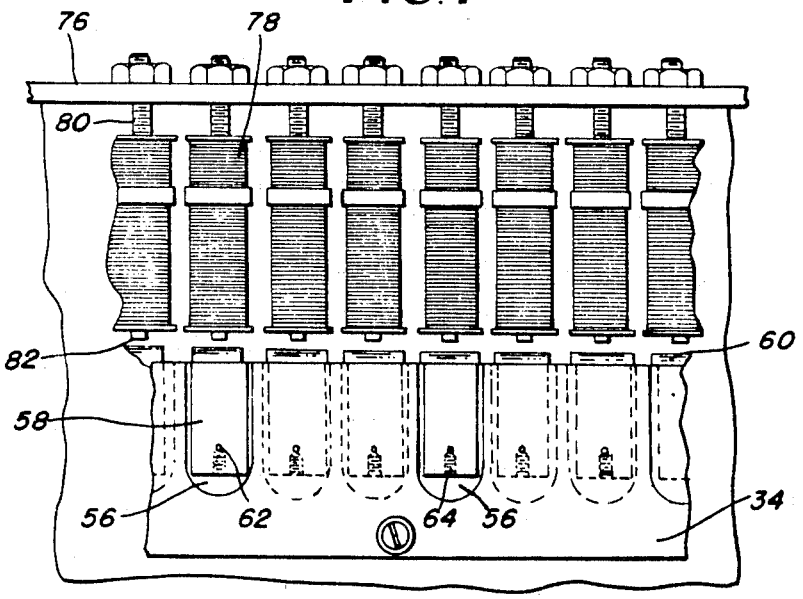
FIG. 2
FIG. 3
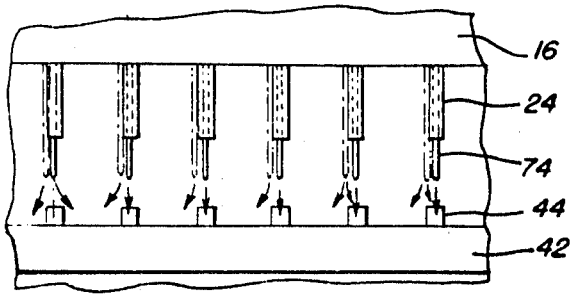

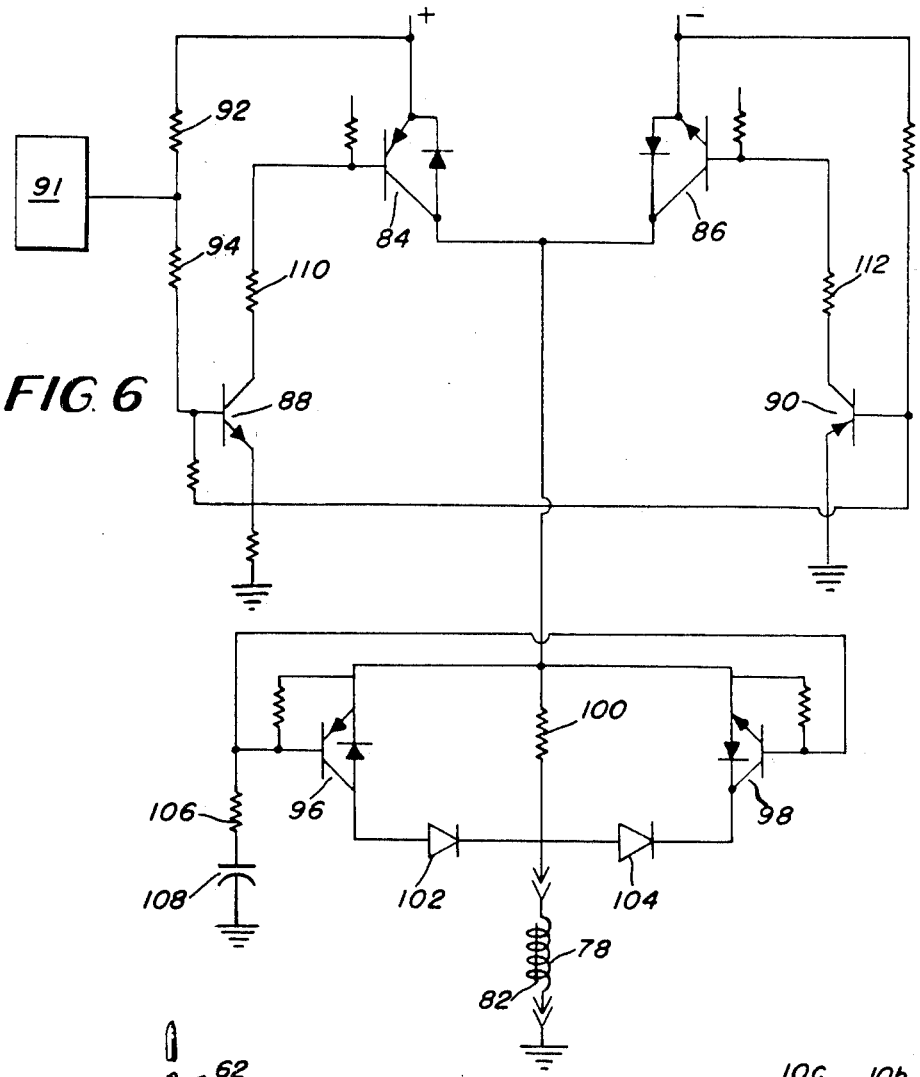
FIG. 6
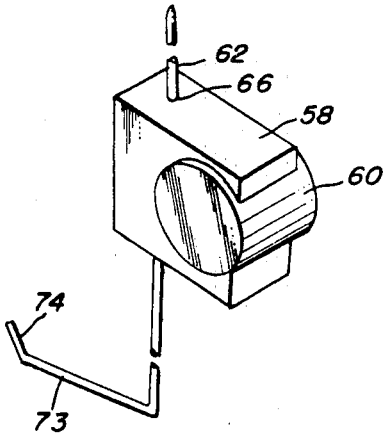
FIG. 4
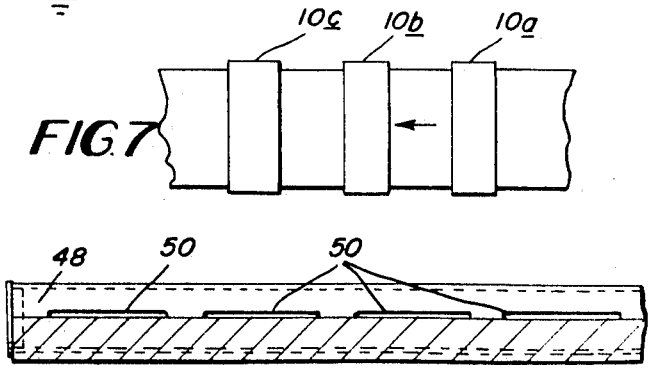
FIG. 7
FIG. 5

JET PRINTER

BACKGROUND OF THE INVENTION

This invention relates to the dyeing of a continuous web of fabric materials and the like, and more particularly to the patterned dyeing or printing of such material by the rapid controlled deflection of the paths of a plurality of dye streams onto or away from the moving web.

Various methods have been used for the patterned dyeing of continuous webs of textile fabrics such as pile carpets to produce various patterns on the web. Penetration of the dyestuffs into the pile and pattern definition or resolution have been major considerations in the prior patterned dyeing of such fabrics. In comparison to the printing of flat textiles or other non-pile material on which dye penetration is not a factor, pile fabric must be deeply penetrated to obtain quality results. Good definition can be obtained by contact printing on flat goods but not on pile fabrics. For example, heat transfer printers which use a paper substrate carrying a patterned heat sensitive dye placed in direct contact with the web to transfer the dye by the application of heat to the paper may be used to produce good resolution on flat goods. The pile height of pile fabrics, however, preclude such a process since the dye cannot penetrate deeply into the pile.

Other prior art printing forms, such as the use of dye containing rollers engraved with a pattern sequentially contacting the fabric, and various screen contacting processes have also suffered from deficiencies relating to dye penetration. Various proposals using rollers and screen printers together with systems applying a vacuum on the opposite side of the fabric from the dye have met with limited success. Screen printers, for example, provide excellent pattern definition but are relatively slow, e.g. in the order of 20 feet per minute. Moreover, when a pattern change is required each set of pattern screens must be replaced by another set thereby resulting in long periods in which the machine is inoperative. Thus, the overall efficiency of such printers is relatively low, especially where short runs of one pattern are made. Pattern rollers also suffer from such disadvantages.

More recently various processes for the printing of textiles have utilized controlled jets of dye sprayed onto the moving fabric web. In such systems a plurality of dye nozzles or spray jets extend from a dye manifold or applicator transversely across the moving web and a number of such applicators, each controlling a different color dye, may be spaced in the direction of movement of the web. Each individual nozzle or jet is controllably activated by suitable electronic, pneumatic or mechanical means to dispense the dye onto the moving web under the control of a pattern controller. Control of the actuation of the individual dye streams determines not only the pattern definition, but also the speed of printing. Individual solenoid valves have been used for selectively and individually controlling the supply of dye to the nozzles, as have been pinching bars to control the flow of dye through flexible dye delivery tubes. Other prior art approaches have used electromagnetically operated needle valves to individually control the application of the dye.

Other proposals, such as illustrated in U.S. Pat. Nos. 3,443,878 and 3,570,275, employ a plurality of continuously flowing dye streams which are selectively deflected by pneumatic jets, electrostatic or electromagnetic deflection devices, or stream blocking and unblocking elements either to permit impingement of the dye stream onto a moving inclined web of fabric or recirculation to a dye supply reservoir. The only known practical utilization of such proposals is the Millitron process which utilizes a controlled pneumatic stream to deflect the dye streams selectively to divert the dye streams out of the path of the fabric and into a catch basin from which the dye is recirculated. This system uses a plurality of solenoid valves controlled by a pattern control system for each dye jet to effect impingement of compressed air against the dye streams to deflect the dye. This system and the controls therefor are disclosed in at least U.S. Pat. Nos. 3,894,413; 4,116,626 and 4,170,883.

In another system, which is disclosed in U.S. Pat. No. 4,341,098 assigned to the common assignee as the present invention, pinch tube valves are provided for pinching flexible tubes to selectively control the flow of dye onto the moving web. That system was devised to overcome the disadvantages of commercially available solenoid liquid control valves, which not only are too slow to permit precise control of small amounts of dye for good pattern definition, but additionally are not drip free. In prior art systems which used solenoid valves to control the flow of liquid, relatively high viscosity dyes and small nozzles had to be employed to prevent dripping. A drawback to the use of high viscosity dye is that additional dye pressure is required to penetrate high pile fabrics, such as carpet, effectively.

A disadvantage of the known systems which use solenoid valves to control pneumatic deflectors, or pinch tube valves to control the flow of dye, is the relatively slow response speeds inherent in such valves. Thus, the speed at which printing can be performed is limited if quality pattern definition is to be obtained.

SUMMARY OF THE INVENTION

Consequently, it is a primary object of the present invention to provide apparatus for dye printing continuous webs of material by selectively rapidly opening and closing the path of dye streams onto the web.

It is another object of the present invention to provide apparatus for dye printing of continuous webs of material by selectively permitting streams of dye to be sprayed onto the web and deflecting other streams of dye out of the path of the web, deflection being by means of rapidly actuated deflecting fingers.

It is a further object of the present invention to provide dye printing apparatus having a plurality of dye streams disposed for flowing in a path onto a continuously moving web, a plurality of fingers disposed for deflecting respective dye streams away from the path, means for rapidly and positively moving the fingers into and out of the path selectively to deflect certain dye streams out of the path while permitting other dye streams to flow onto the web.

It is a still further object of the present invention to provide dye printing apparatus having a plurality of dye streams disposed above a moving web for flowing in a path directed onto the web, a plurality of fingers pivotably constrained for movement about an axis disposed above the web for pivoting into and out of the paths for deflecting the dye streams out of the respective path and away from the web, the fingers being carried by support blocks, and means for moving the support blocks rapidly and selectively for pivoting the fingers into and out of the paths.

Accordingly, the present invention provides apparatus for printing a moving web of material by application of a plurality of streams of liquid dye onto the web, the streams being selectively permitted to contact the web or to be diverted from the web by means of deflecting fingers which are selectively moved into and out of the streams.

The apparatus of the present invention comprises a dye supply member, such as a tube, corresponding to each dye stream, the tubes being disposed above the moving web. The deflecting fingers are disposed for movement selectively into and out of the path of respective dye streams exiting the tubes. When a finger enters the path of a dye stream that stream is deflected onto a dye removal member preferably for recirculation into the system. Those streams that are not deflected flow onto the web, preferably through a dye stream discharge tube disposed below and in flow communication with the respective dye supply tube.

The fingers are carried in respective support blocks mounted above the web moving conveyor, each finger being constrained for pivotable movement about an axis disposed above the web and preferably normal thereto. The fingers preferably are rods having an elongated mounting portion disposed coincidentally with the pivot axis connected to a respective support block and an offset deflecting portion moveable radially relatively to the mounting portion into and out of the streams. Also carried by each block spaced from the finger mounting portion is a signal responsive member driven in response to a control signal, the signal responsive member moving the block as constrained by the mounting portion of the finger, thereby to pivot the finger about the pivot axis.

Each signal responsive member according an important aspect of the invention is a permanent magnet disposed in the respective support block with its magnetic poles adjacent an electromagnetic coil in a control circuit, the control signal being applied to the coil by a switching circuit actuated by a pattern controller. Whenever the control signal changes polarity one pole of the magnet is attracted toward the coil and the other pole is repelled away from the coil. In the preferred form of the invention the magnet is a bar magnet, the preferred form being a small cylindrical or disc shaped bar magnet which has a relatively high flux density for its size, the periphery of the magnet being disposed adjacent the core of the coil, and the axis of the magnet being spaced from and skewed relative to the pivot axis of the fingers, i.e., the axis of the magnet is neither parallel nor perpendicular to the pivot axis of the fingers. With this construction switching of polarity can effect movement of the magnet and thus the fingers very rapidly, e.g. in the order of 10 milliseconds.

Banks of finger deflectable dye streams spaced apart in the direction of movement of the web and feeding different color dyes to the respective banks effect the printing of the web in accordance with the pattern controller which may be a conventional digital computer programmed by conventional programming techniques. The system is particularly effective for dye printing pile fabric textiles such as tufted carpets.

DESCRIPTION OF THE DRAWINGS

The particular features and advantages of the invention as well as other objects will become apparent from the following description taken in connection with the accompanying drawings, in which:

FIG. 1 is an end elevational view of a dye jet printer having a bank of deflecting fingers spaced transversely to the direction of travel of a web of material to be printed, transversely adjacent fingers being mounted in vertically staggered mounting blocks;

FIG. 2 is a fragmentary top plan view of the apparatus illustrated in FIG. 1;

FIG. 3 is a fragmentary front elevational view thereof illustrating six transversely spaced dye supply and discharge tubes and respective fingers;

FIG. 4 is a perspective view of a deflection finger and its associated support block and signal responsive magnet;

FIG. 5 is a fragmentary cross sectional view taken substantially along line 5—5 of FIG. 1;

FIG. 6 is a schematic diagram of the electrical circuit for controlling the switching of a dye stream on and off; and FIG. 7 is a diagrammatic diagram of a series of three printing banks.

DESCRIPTION OF THE PREFERRED EMBODIMENT

Referring to the drawings, FIG. 1 illustrates an end elevational view of a bank of dye heads of a printer 10 constructed in accordance with the principles of the present invention. Although only a single bank is there illustrated it should be understood that two, three or more such banks will generally be utilized in tandum spaced apart in the direction of movement of a web 12 to be printed. The web 12 is disposed below the printer dye heads on a moving platform 14 of conventional conveying apparatus so as to be continuously fed beneath the heads.

Each bank of dye heads comprises a frame including a main body member or dye housing 16 having a hollow dye cavity 18 extending transversely therethrough. The body members may be supported at opposite ends of the bank on rails 20 (only one of which is illustrated). The cavity 18 forms a dye manifold through which liquid dye is fed by means of a plurality of dye inlet conduits connected to respective inlet couplings 22 (only one of which is illustrated) opening into and communicating with the cavity 18. Spaced transversely across the body member 16 and depending downwardly therefrom is a plurality of hollow dye supply tubes 24, each tube being fastened to the body member and communicating with the cavity 18. Thus, dye flowing through the cavity or manifold 18 enters the tubes 24 and flows out the lower end toward the web. The body member 16 is stepped down at 26 at a disposition spaced laterally from the cavity 18 at approximately half the lateral width of the body member.

Disposed on the top of the body member 16 are the lower ends of a plurality of hollow posts 28. A transversely elongated support plate 30 is disposed on the posts 28 and securing means such as a bolt 32 extends through the support plate and each respective post and is threadedly received in the body member 16 for securing the support plate in vertically spaced disposition above the body member. Although other support plates may be mounted above the support plate 30, it is preferred that one additional support plate 34 be utilized and it is supported by posts 36 similar to the posts 28 disposed on the plate 30, and that the bolts 32 are elongated so as to extend through the plate 34 and the posts 36 in addition to the plate 30 and the posts 28. Both support plates 30, 34 preferably extend laterally above the body member from a disposition just rearwardly of the cavity 18 to the location of the step 26 and transversely are substantially the same length as the body member.

Carried by the body member 16 from posts 38, 40 secured to and depending downwardly therefrom at locations spaced along the stepped down portion is a dye stream discharge tube support and return block 42. The block 42 carries a plurality of hollow dye discharge tubes 44, which may be cylindrical in configuration and preferably have a larger diameter than the supply tubes 24. Each tube 44 corresponds to and is disposed in direct axial alignment with a respective one of the supply tubes 24. The tubes 44 are fixed within bores of the block 42, the bores opening at the bottom surface of the block so that dye flowing through the tubes 24 may enter the respective tube 44 and flow as a stream onto the web 12 therebelow. The surface 46 of the block 42 into which the tubes 44 enter is inclined as illustrated so that any deflected dye not permitted to enter the tubes 44, as hereinafter described, and any dye that may possibly splash off the entering end of the tubes 44, will flow down the incline toward the valley at the intersection of the surface 46 and the joining upstanding surface 48. As illustrated in FIG. 5 the surface 48 has a transverse series of slots 50 which extend through the block and communicate with a transversely extending cavity 52, the ends of which are capped as illustrated. Also communicating with the cavity 52 is one or more conduits 54 to which a vacuum pump (not illustrated) may be connected to remove the dye entering the cavity 52 for removal and preferably recirculation through the system.

The body member 16 and each of the support plates 30, 34 include a recess 56 in the respective upper surfaces opening onto the stepped edge 26 of the body member 16 and overlaying edges of the plates 30, 34 respectively, such as illustrated in FIG. 2 with respect to the plate 34. The recesses 56 are staggered transversely between the body member and the support plates so that they are non-aligned transversely. Disposed within each recess 56 is a support block or housing 58 preferably in the form of a rectangular block constructed of aluminum or other non-magnetic material. Moreover, it is preferred that the body member 16 and the plates 30, 34 also be of a non-magnetic material, such as plastic. Fastened within each block 58 and extending slightly out a leading edge thereof is a permanent magnet 60, the magnet being a cylindrical or disc shaped bar magnet having its elongated axis extending substantially normal to the ends of the respective blocks so that a peripheral portion of the magnet extends out the edge of the block. When the blocks are disposed in the respective recesses, the peripheral portion of the magnet preferably extends beyond the edge of the step 26 and the corresponding edges of the plates 30, 34.

Each block 58 further includes a vertically extending bore 66 through which an elongated rod 62 extends and within which it is secured by set screws 64 or the like. A plurality of transversely spaced bores 68, 70, 72 are respectively formed in the body member 16 and the support plates 30, 34, each set of bores 68, 70, 72 being aligned one with the other and a respective rod extends therethrough so as to be positively constrained to pivotable movement about the respective axis of the bores. Each block 58 is thus also likewise constrained for pivotable movement with the rod secured therein. If found feasible the rods 62 connected to the blocks mounted in the recesses of the body member may only extend through the bores 68 and likewise the rods associated with the plate 30 may only extend through the bores 68 and 70, but more positive constraint is attained by having them extend through both plates 30, 34 and the body member 16, in which case all the rods may be identical and thus provide ease of manufacture and less inventory of various items.

Beneath the lower edge of the body member 16 each rod 62 has a first bent or offset portion 73 directed toward the respective tube 24, the portion 73 terminating at a second offset portion 74 which extends to the free end and may be disposed beneath and preferably extend beyond the remote periphery of the respective tube 24 when the vertically elongated mounting portion of the rod is pivoted to effect such disposition of the portion 74. Thus, the portion 74 of each rod forms a deflecting finger which may be moved into the path of the dye stream exiting the respective tube 24 to deflect the stream.

Secured to and upstanding from the stepped down portion 26 of the body member 16 is a control support plate 76 to which a plurality of electromagnetic coils 78 are fastened by means of threaded members 80 secured to one end of the respective cores 82 of the coils, the coils being disposed in an array so that the other end of the cores are disposed adjacent to and spaced slightly from the projecting peripheral portion of a respective magnet 60. Thus, when the polarity of the coil is switched, one end or the other is attracted or repelled from the end of the respective coil core 82 thereby pivoting the block 58 within which the magnet 60 is mounted about the pivotal constraint of the mounting portion of the rod 62, thereby effecting movement of the respective deflecting finger 74 into or out of the flow path of its respective dye supply tube 24. When a finger enters the path of the tube 24, the dye from that tube is deflected from entering the respective tube 44 and flows onto the inclined surface 46 of the tube support and return block 42. Surface tension of the dye aids in assuring that the dye flows along the deflecting finger 74 to the junction of the first offset portion 73 where the dye drops onto the surface 46 and enters the slots 50. Those dye streams not deflected enter and flow through the respective tubes 44 to contact the web 12.

The control circuit for moving one of the magnets 60, and thus its associated deflecting finger into and out of the dye stream exiting the respective supply tube 24, is illustrated in FIG. 6. Transistors 84, 86, 88, 90 form the switching network for changing the polarity of the corresponding coil 78 in response to a signal from a pattern controller such as a computer 91. The switching transistors receive the signal from the pattern controller at the junction of the resistors 92 and 94, the signal being utilized to control the circuit by cut-off and saturation of the pattern contoller, e.g., the computer.

The coil 78 is switched between a positive and negative voltage of approximately 24 volts at full current and the current is reduced to a holding current level by switching off transistors 96 and 98 so that resister 100 then supplies the low level idle current to the coil 78. The transistors 96, 98 and diodes 102, 104 comprise a current limiting network to reduce the current to the coil after the magnet has been moved into position by the coil. This prevents the coil core from becoming saturated while awaiting a command from the pattern controller and provides a faster coil switching response. The diodes 102, 104 block the transistors 96, 98 from reverse voltages. A resistor 106 and capacitor 108 form a time delay that biases on the transistors 96 and 98 only during switching of polarity and a short time thereafter, in the order of a few milliseconds after the start of the switch command from the pattern controller.

During current cut-off the control voltage at the junction of resistors 92 and 94 is not affected and will be positive, in the order of approximately 14 volts, and the base of transistor 88 will have a small positive voltage of about 2 volts. This results in transistor 88 conducting and drawing current through the resistor 110 and the base of the transistor 84, thereby supplying a positive voltage to the coil 78. While transistor 84 is conducting, the transistor 86 is biased off by transistor 90 which receives its biased voltage from the emitter of transistor 88. Transistor 90 is thereby reversed biased by the positive voltage at the emitter of the transistor 88 while it is conducting. When the positive voltage at the junction of resistors 92, 94 is changed by the pattern controller to zero volts the transistor 88 becomes reverse biased thereby biasing the transistor 84 to the off state. Because the transistor 88 stops conducting, the voltage at the emitter of the transistor 88 becomes less positive and the voltage at the base of the transistor 90 becomes slightly negative, thereby biasing the transistor 90 to conduct. This results in flow of current through the resistor 112 and the base of the transistor 86 to effect conduction of current through that transistor and to place a negative voltage across the coil to move the magnet from the position it was in due to the positive voltage on the coil during cut-off. Each coil is controlled in this manner, and may be switched individually and selectively between the positive and negative voltage to move its respective magnet 60 and thus pivot the respective block 58 to move the deflecting finger 74 into or out of the dye path from the respective tube 24.

FIG. 7 illustrates diagrammatically the use of three banks of printer dye heads 10*a*, 10*b* and 10*c* spaced in tandum along the path of travel of the web 12. By transversely staggering the streams of dye from one bank to the next a very close gauge between the transverse streams can be attained to fully print across the entire width of the web. Moreover, the banks may have different colored dyes which can effect a multicolor printing of the web. By selectively programming the computer or other pattern controller by conventional techniques, substantially any pattern may be printed on the web.

Numerous alterations of the structure herein disclosed will suggest themselves to those skilled in the art. However, it is to be understood that the present disclosure relates to the preferred embodiment of the invention which is for purposes of illustration only and not be be construed as a limitation of the invention. All such modifications which do not depart from the spirit of the invention are intended to be included within the scope of the appended claims.

Having thus set forth the nature of the invention, what is claimed herein is:

1. Apparatus for printing a moving web of sheet material by the selective application of a plurality of spaced streams of liquid dye onto the web, said apparatus comprising a bank of dye supply members spaced above the web, means for supplying dye to said members, a dye discharge member corresponding to each dye supply member, support means for supporting said discharge members intermediate said supply members and said web in flow communication with a corresponding supply member for receiving dye therefrom and discharging same onto said web, deflector support means disposed above said web, a plurality of deflecting members having a deflecting finger and a mounting portion, said deflector support means including means for constraining said mounting portions for pivotable movement about a pivot axis, each of said deflecting fingers being disposed for movement into and out of a disposition deflecting flow communication between a corresponding dye supply member and dye discharge member, a pivot block corresponding to each deflecting member carried by said deflector support means, each of said mounting portions being fastened to a corresponding pivot block so that the pivot block may pivot about said axis, a signal responsive member carried by each pivot block, signal generating means spaced from a respective signal responsive member for generating a control signal in accordance with a preselected pattern for selectively moving the respective signal responsive member about said pivot axis, whereby said pivot block and deflecting finger pivot about said axis to move the deflecting finger into and out of deflecting relationship with the stream of dye exiting the corresponding supply member to deflect the dye stream out of flow communication with the corresponding discharge member selectively, and means for catching and removing the dye deflected by the fingers.

2. Apparatus as recited in claim 1, wherein each of said signal responsive members comprises a permanent magnet, said signal generating means comprising an electromagnetic coil, and means for selectively changing the electrical polarity of the coil in response to the pattern.

3. Apparatus as recited in claim 2, wherein said magnet is a bar magnet having an elongated axis laterally spaced from the pivot axis.

4. Apparatus as recited in claim 3, wherein said magnet has a cylindrical configuration and the coil is disposed adjacent a peripheral portion thereof.

5. Apparatus as recited in claim 4, wherein the axis of said magnet is skewed relative to said pivot axis.

6. Apparatus as recited in claim 1, wherein each deflecting member comprises a rod, the mounting portion being elongated along said pivot axis, and each deflecting finger being offset relative to said mounting portion.

7. Apparatus as recited in claim 1, wherein said discharge members are disposed in vertical alignment with respective supply members.

8. Apparatus as recited in claim 7, wherein each of said signal responsive members comprises a permanent magnet, said signal generating means comprising an electromagnetic coil, and means for selectively changing the electrical polarity of the coil in response to the pattern.

9. Apparatus as recited in claim 8, wherein said magnet is a bar magnet having an elongated axis laterally spaced from the pivot axis.

10. Apparatus as recited in claim 9, wherein said magnet has a cylindrical configuration and the coil is disposed adjacent a peripheral portion thereof.

11. Apparatus as recited in claim 10, wherein the axis of said magnet is skewed relative to said pivot axis.

12. Apparatus as recited in claim 7, wherein each deflecting member comprises a rod, the mounting portion being elongated along said pivot axis, and each deflecting finger being offset relative to said mounting portion.

13. Apparatus as recited in claim 12, wherein each of said signal responsive members comprises a permanent magnet, said signal generating means comprising an electromagnetic coil, and means for selectively changing the electrical polarity of the coil in response to the pattern.

14. Apparatus as recited in claim 13, wherein said magnet is a bar magnet having an elongated axis laterally spaced from the pivot axis.

15. Apparatus as recited in claim 14, wherein said magnet has a cylindrical configuration and the coil is disposed adjacent a peripheral portion thereof.

16. Apparatus as recited in claim 15, wherein the axis of said magnet is skewed relative to said pivot axis.

17. Apparatus as recited in claim 1, wherein said means for catching and removing the deflected dye includes an inclined surface carried by said support means, and suction means for removing said deflected dye from said surface.

18. Apparatus as recited in claim 17, wherein said discharge members comprise tubes upstanding from said inclined surface.

19. Apparatus for printing a moving web of sheet material by selective application of a plurality of spaced streams of liquid dye onto the web, said apparatus comprising at least one bank of dye supply tubes spaced above the web, means for supplying dye to said tubes, a dye discharge tube corresponding to each dye supply tube, support means for supporting said discharge tubes intermediate said supply tubes and said web, each discharge tube being disposed in alignment with a corresponding supply tube for receiving dye therefrom and discharging same onto said web, deflector support means disposed above said web, a plurality of deflecting members having a deflecting finger and a mounting portion, said mounting portions being constrained for pivotable movement about a pivot axis within said deflector support means, each of said deflecting fingers being disposed for movement intermediate a corresponding dye supply tube and a respective dye discharge tube for deflecting a stream of dye exiting the supply tube out of the path of the corresponding dye discharge tube, a pivot block corresponding to each deflecting member carried by said deflector support means, each of said mounting portions being fastened to a corresponding pivot block so that the pivot block may pivot about said axis, a signal responsive member carried by each pivot block spaced from the respective deflecting member mounting portion, signal generating means spaced from a respective signal responsive member for generating a control signal in accordance with a preselected pattern for selectively moving the respective signal responsive member about said pivot axis, whereby said pivot block and deflecting finger pivot about said axis to move the deflecting finger into and out of deflecting relationship with the stream of dye exiting the corresponding supply tube to deflect the dye stream out of the path with the corresponding discharge tube selectively, and means for catching and removing the dye deflected by the fingers.

20. Apparatus as recited in claim 19, wherein each of said signal responsive members comprises a permanent magnet, said signal generating means comprising an electromagnetic coil, and means for selectively changing the electrical polarity of the coil in response to the pattern.

21. Apparatus as recited in claim 20, wherein said magnet is a bar magnet having an elongated axis laterally spaced from the pivot axis.

22. Apparatus as recited in claim 21, wherein said magnet has a cylindrical configuration and the coil is disposed adjacent a peripheral portion thereof.

23. Apparatus as recited in claim 22, wherein the axis of said magnet is skewed relative to said pivot axis.

24. Apparatus as recited in claim 19, wherein said discharge tubes are disposed in vertical alignment with respective supply tubes.

25. Apparatus as recited in claim 24, wherein each deflecting member comprises a rod, the mounting portion being elongated along said pivot axis, and each deflecting finger being offset relative to said mounting portion.

26. Apparatus as recited in claim 25, wherein each of said signal responsive members comprises a permanent magnet, said signal generating means comprising an electromagnetic coil, and means for selectively changing the electrical polarity of the coil in response to the pattern.

27. Apparatus as recited in claim 26, wherein said magnet is a bar magnet having an elongated axis laterally spaced from the pivot axis.

28. Apparatus as recited in claim 27, wherein said magnet has a cylindrical configuration and the coil is disposed adjacent a peripheral portion thereof.

29. Apparatus as recited in claim 28, wherein the axis of said magnet is skewed relative to said pivot axis.

* * * * *